US007907097B2

(12) United States Patent
Syed et al.

(10) Patent No.: US 7,907,097 B2
(45) Date of Patent: Mar. 15, 2011

(54) SELF-SUPPORTING UNITARY FEED ASSEMBLY

(75) Inventors: Junaid Syed, Kirkcaldy (GB); Chris Hills, Fife (GB)

(73) Assignee: Andrew LLC, Hickory, NC (US)

( * ) Notice: Subject to any disclaimer, the term of this patent is extended or adjusted under 35 U.S.C. 154(b) by 387 days.

(21) Appl. No.: 11/779,064

(22) Filed: Jul. 17, 2007

(65) Prior Publication Data

US 2009/0021442 A1 Jan. 22, 2009

(51) Int. Cl.
*H01Q 19/19* (2006.01)

(52) U.S. Cl. ..... 343/781 P; 343/781 CA; 343/785

(58) Field of Classification Search ..... 343/781 P, 343/781 CA, 785

See application file for complete search history.

(56) References Cited

U.S. PATENT DOCUMENTS

| | | | | |
|---|---|---|---|---|
| 2,605,416 | A | 7/1952 | Foster | |
| 4,673,945 | A | 6/1987 | Syrigos | |
| 4,673,947 | A | 6/1987 | Newham | |
| H584 | H | 2/1989 | Schwering et al. | |
| 4,963,878 | A | 10/1990 | Kildal | |
| 5,959,590 | A | 9/1999 | Sanford et al. | |
| 5,973,652 | A | 10/1999 | Sanford et al. | |
| 6,020,859 | A * | 2/2000 | Kildal | 343/781 CA |
| 6,107,973 | A | 8/2000 | Knop et al. | |
| 6,137,449 | A | 10/2000 | Kildal | |
| 6,429,826 | B2 | 8/2002 | Karlsson et al. | |
| 6,522,305 | B2 | 2/2003 | Sharman | |
| 6,697,027 | B2 * | 2/2004 | Mahon | 343/781 CA |
| 6,724,349 | B1 | 4/2004 | Baird et al. | |
| 6,862,000 | B2 | 3/2005 | Desargant et al. | |
| 6,919,855 | B2 | 7/2005 | Hills | |
| 6,985,120 | B2 | 1/2006 | Lewry et al. | |
| 6,995,727 | B2 | 2/2006 | Tuau et al. | |
| 2005/0017916 | A1 * | 1/2005 | Lewry et al. | 343/786 |
| 2005/0062663 | A1 * | 3/2005 | Hills | 343/781 P |
| 2008/0030417 | A1 | 2/2008 | Aramaki et al. | |

FOREIGN PATENT DOCUMENTS

| | | |
|---|---|---|
| EP | 197350 | 10/1986 |
| EP | 475294 | 3/1992 |
| JP | 62000106 | 1/1987 |
| JP | 62204604 | 9/1987 |

OTHER PUBLICATIONS

PCT International Search Report, issued Jan. 12, 2009 for related international application, serial No. PCT/IB2008/052518.

PCT Partial Search Report, issued Nov. 4, 2008 for related international application, serial No. PCT/IB2008/052518.

* cited by examiner

*Primary Examiner* — Tho G Phan
(74) *Attorney, Agent, or Firm* — Babcock IP, PLLC

(57) ABSTRACT

A feed assembly for a reflector antenna having a unitary portion of dielectric material, a proximal end of the unitary portion configured for connection with the reflector antenna. The unitary portion having a waveguide portion extending between the proximal end and a sub reflector support having a sub reflector surface at a distal end. The waveguide portion and the sub reflector surface covered with an RF reflective material. The unitary portion may be cost effectively formed via, for example injection molding and or machining. Alternatively, the feed assembly may be formed as a horn feed, without a sub reflector.

18 Claims, 7 Drawing Sheets

SELF-SUPPORTING UNITARY FEED ASSEMBLY

BACKGROUND

1. Field of the Invention

This invention relates to feed assemblies for reflector antennas. More particularly, the invention provides improvements in reflector antenna feed assembly electrical performance and cost efficiency via a unitary solid dielectric self supporting feed assembly.

2. Description of Related Art

Many broadcast and or communications systems require antennas with a highly directional signal reception and or transmission characteristic. Reflector antennas focus a signal received by a dish shaped reflector upon the feed horn of a centrally mounted receiver. Because the dish shaped reflector only focuses a signal received from a single direction upon the receiver or a sub reflector that further directs the signal to the receiver, reflector antennas are highly directional. When the reflector antenna is used to transmit a signal, the signals travel in reverse, also with high directivity.

Reflector antennas with a sub reflector supported and fed by a waveguide are relatively cost efficient and allow, for example, location of the transmitter and or receiver in an easily accessible location on the back of the reflector. This configuration eliminates the need for a support structure that spans the face of the reflector, partially blocking the reflector, and signal losses associated with passing the signal through an extended waveguide or cable routed along the support structure. A waveguide with a generally circular or elliptical cross section provides the antenna with dual polarization capability.

Electrical performance of a dual polarized reflector antenna with a self supported feed is typically measured with respect to gain, cross polarization, edge illumination and return loss characteristics.

Prior reflector antenna feed assemblies typically comprise a sub reflector attached to a waveguide by a dielectric block that positions the sub reflector at a desired orientation and distance from the end of the waveguide. Alternatively, the reflector antenna may focus the signal upon a feed horn formed at a waveguide end or a separately supported sub reflector that then focuses the signal upon a feed horn/waveguide. When a separate feed horn configuration is used, a dielectric cover, radome or other environmental seal is applied to protect the open end of the waveguide.

The interfaces between the environmental seal(s), dielectric block, waveguide, sub reflector and any adhesives or mechanical interlocks used to secure the components together create impedance discontinuities that are significant sources of return loss. Also, the metal waveguides are typically structural elements with a significant thickness, creating edge radiation characteristics that contribute to the generation of backlobes in the antenna signal pattern.

U.S. Pat. No. 6,919,855 issued Jul. 19, 2005 to Hills, assigned to Andrew Corporation as is the present invention, describes dielectric blocks incorporating corrugations in the dielectric surface for pattern and return loss optimization. A subreflector is formed by metalizing the desired subreflector surface of the dielectric block.

U.S. Pat. No. 6,985,120 issued Jan. 10, 2006 to Lewry et al., assigned to Andrew Corporation as is the present invention, describes a reflector antenna with a self supported feed assembly formed as a hollow dielectric waveguide and cone coupled at the narrow end to the reflector dish and at the wide end joined to a sub reflector surface. Formed via injection molding from a dielectric material, the waveguide and sub reflector surfaces have a thin metallic surface coating to contain and reflect radio frequency signals. However, a slight taper along at least the waveguide inner diameter, to improve injection molding mold separation, degrades the electrical performance. Also, the thickness of the dielectric along the cone and waveguide portions is a trade off between strength and an impedance discontinuity that is difficult to match for, without adding an additional impedance matching element.

Competition within the reflector antenna industry has focused attention on antenna designs that reduce antenna materials and manufacturing costs but which still satisfy and or improve upon stringent electrical specifications, Therefore, it is an object of the invention to provide an apparatus that overcomes deficiencies in the prior art.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

A circular type waveguide may be selected as the feeder line of a feed assembly, to enable dual polarization operation. The energy inside the waveguide can travel in various TE and TM modes, which determines the orientations of electric and magnetic field vectors with respect to the direction of energy propagation.

The cut off frequency of each mode in a dielectric filled circular waveguide is determined by the internal diameter of the waveguide and the dielectric properties of the material.

Figure 1:
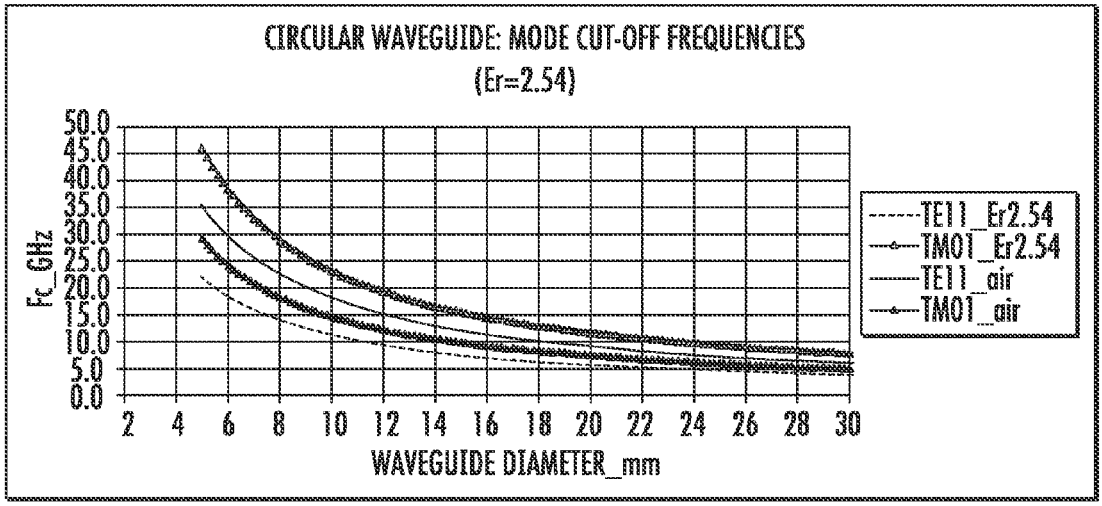
FIG. 1 is a chart demonstrating the cut off frequency for TE11 and TM01 modes with respect to waveguide diameter for solid dielectric and air filled circular waveguides.

The amplitude and phase of energy, propagating in the waveguide, in a specific mode depends upon the waveguide dimensions, any discontinuity present in the waveguide and the frequency of operation. Because it has the lowest cut-off frequency, the fundamental mode in a circular waveguide is TE11. The next cut-off frequency in a circular waveguide is for TM01. The cut-off frequencies for the TE11 and TM01 mode of propagation in an air filled and dielectric filled (Er=2.54) open ended circular wave guide, are shown in FIG. 1.

The attenuation of the energy in the waveguide above cut off frequencies for a particular mode of propagation depends upon the loss tangent of the dielectric present in the waveguide, conduction losses of the boundaries and diameter of the waveguide. Therefore, a low loss dielectric and good conductivity of the waveguide sidewalls is preferred. As the diameter of the waveguide is reduced, the conduction loss may increase and dielectric loss may decrease. Hence, if the waveguide is filled with dielectric a trade-off will be required for selecting the diameter of the waveguide from a modes and waveguide attenuation point of view.

The inventors have recognized that, by restricting the diameter of the circular waveguide, for a given dielectric material, the higher order modes can be excluded and the design then based upon a known fundamental mode of propagation. Thereby, the aperture field distribution at the exit aperture of the solid dielectric waveguide may be easily modeled. For example, 28 GHz radiation patterns, computed using the finite-difference time-domain (FDTD) method, from an open ended circular waveguide (diameter=7.04 mm) filled alternatively with air and solid dielectric are generally equivalent because the higher order modes are not activated.

Figure 2:
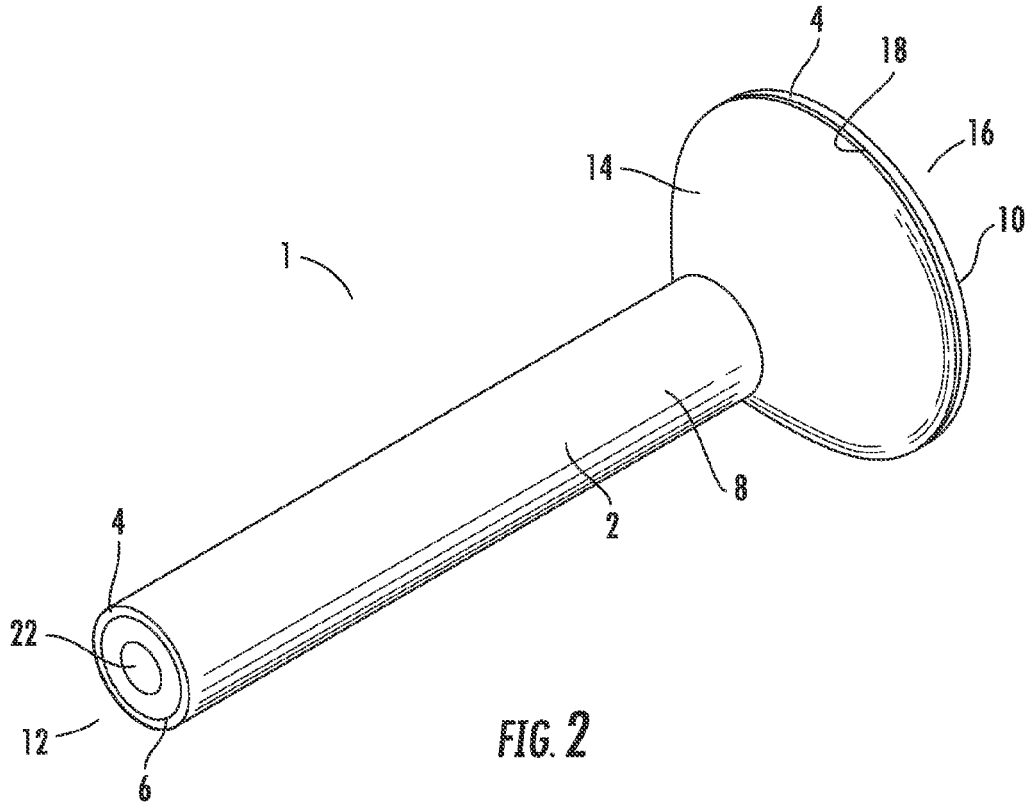
FIG. 2 is a schematic isometric view of a first embodiment of the invention.
Figure 3:
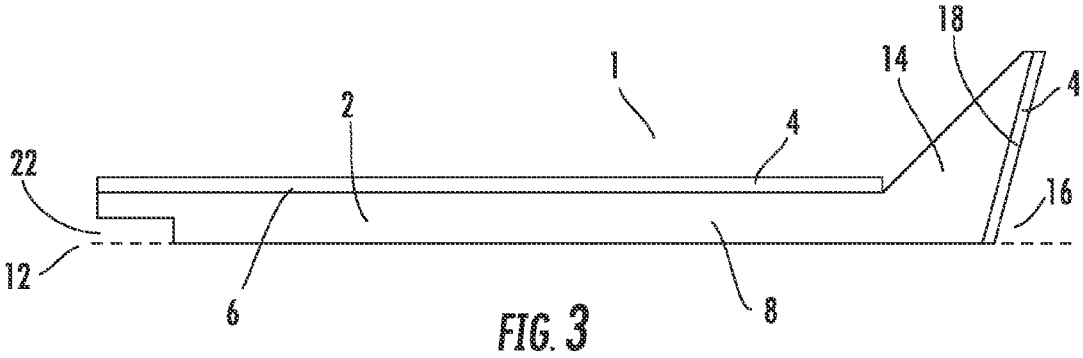
FIG. 3 is a side section, one half removed for clarity, view of a feed assembly according to the first embodiment of the invention.

As shown for example in FIGS. 2 and 3, a feed assembly 1 for a reflector antenna may be formed as a unitary portion 2 of dielectric material with radio frequency (RF) reflective material 4 covering outer surface coated area(s) 6 and a sub reflector surface 18 to form a waveguide portion 8 and a sub reflector 10.

A proximal end 12 of the waveguide portion 8 is adapted for mounting to the reflector antenna and or to a transition element such as an adaptor hub 30 (see FIG. 8) of the reflector antenna. The proximal end 12 and the reflector antenna mounting point may be configured for simplified plug-in coupling via interference fit, mechanical interlock, adhesives or the like. The waveguide portion 8 flares into a cone shaped sub reflector support 14 having a distal end 16 sub reflector surface 18 which, when coated with the RF reflective material 4 becomes the sub reflector 10, positioned and dimensioned to distribute RF signals from the waveguide portion 8 to the reflector dish and vice versa.

Figure 4:
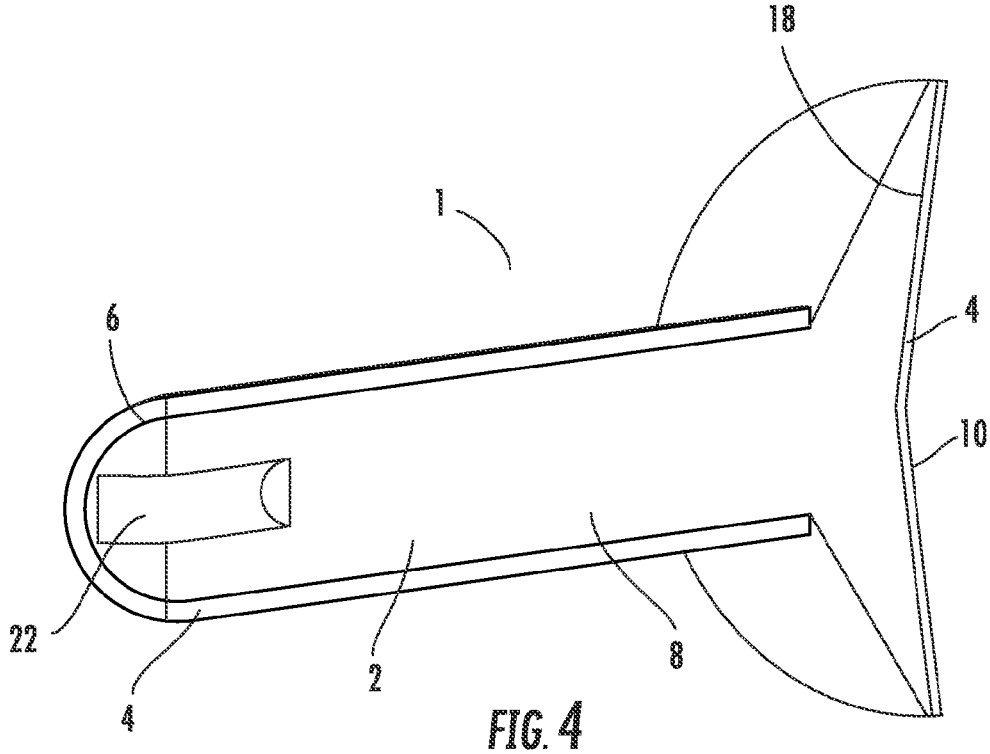
FIG. 4 is an isometric cut-away view of a feed assembly according to the first embodiment of the invention, showing an alternative form of an impedance transformer.
Figure 5:
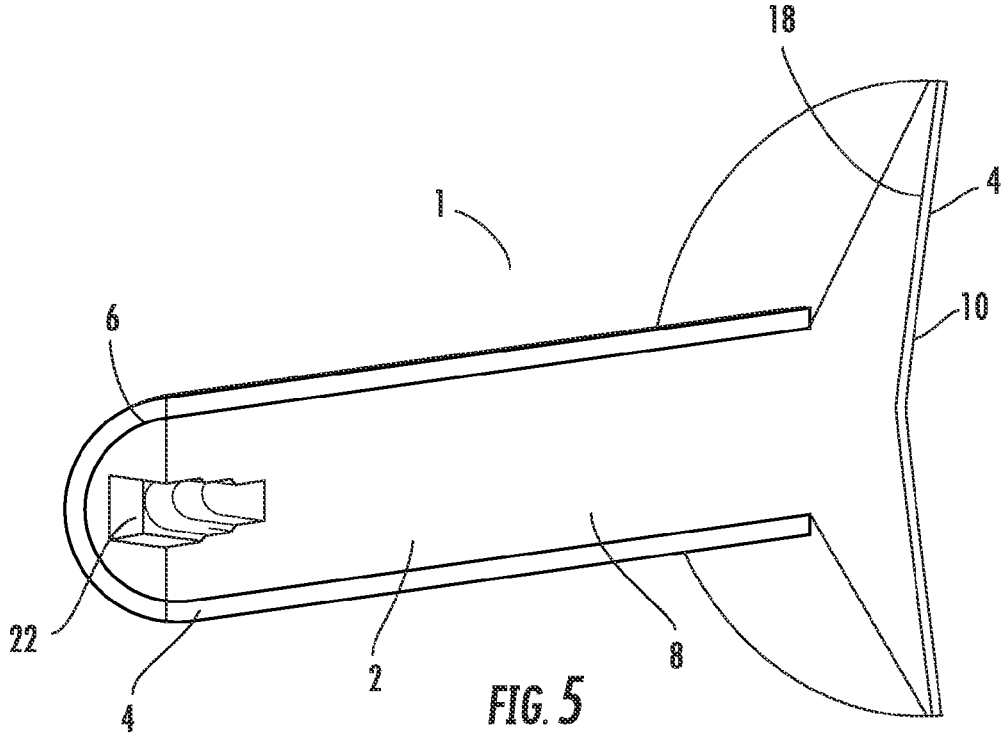
FIG. 5 is an isometric cut-away view of a feed assembly according to the first embodiment of the invention, showing another alternative form of an impedance transformer.

An impedance transformer 22, as best shown in FIGS. 4 and 5, may be formed in the proximal end 12 of the waveguide portion 8 to minimize an impedance mismatch between the feed assembly and the further path of RF signals. The proximal end 12 may also be formed as a transition element, for example between a circular and rectangular waveguide or other proprietary interface with the receiver, transmitter or transceiver equipment.

The feed assembly 1 may be formed by, for example machining the unitary portion 2 from a block of dielectric material to the desired dimensions and or via injection molding. Because the feed assembly 1 is solid, with minimal internal cavities or other features that would interfere with injection mold separation or complicate mechanical machining techniques, manufacture is greatly simplified. Preferably, the selected dielectric material is non-porous to minimize the presence of impedance discontinuities.

Coating the desired portions of the feed assembly 1 with RF reflective material 4 may be performed via metalizing, electroplating, painting or application of metallic tape. Where metalizing is applied, the resulting coating may be extremely thin, resulting in minimal edge diffraction signal pattern degradation at the distal end 16 of the waveguide portion 8 and sub reflector 10 outer edge. To improve pattern control, an anisotropic impedance boundary may be added by over molding the sub reflector support 14. Metals and alloys thereof that may be applied as the RF reflecting material 4 include, for example, aluminum, copper, silver and gold. To minimize oxidation, the RF reflecting material may be further sealed with an oxygen and or water barrier coating.

The thin RF reflective material 4 coating obtainable via metalizing also has the advantage of adding minimal overall weight to the resulting feed assembly 1, which lowers the necessary structural characteristics of the dielectric material selected for the unitary portion 2 of the feed assembly 1.

Figure 6:
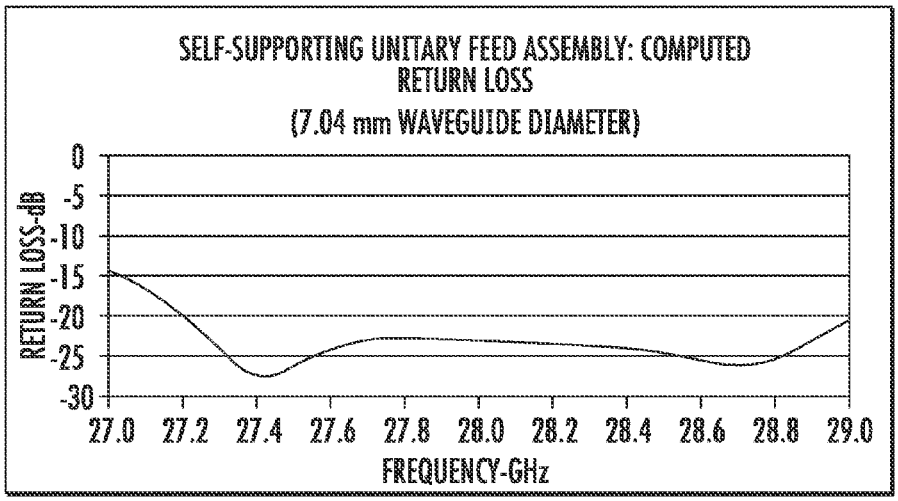
FIG. 6 is a chart showing the computed return loss for the feed assembly of FIG. 2.
Figure 7:
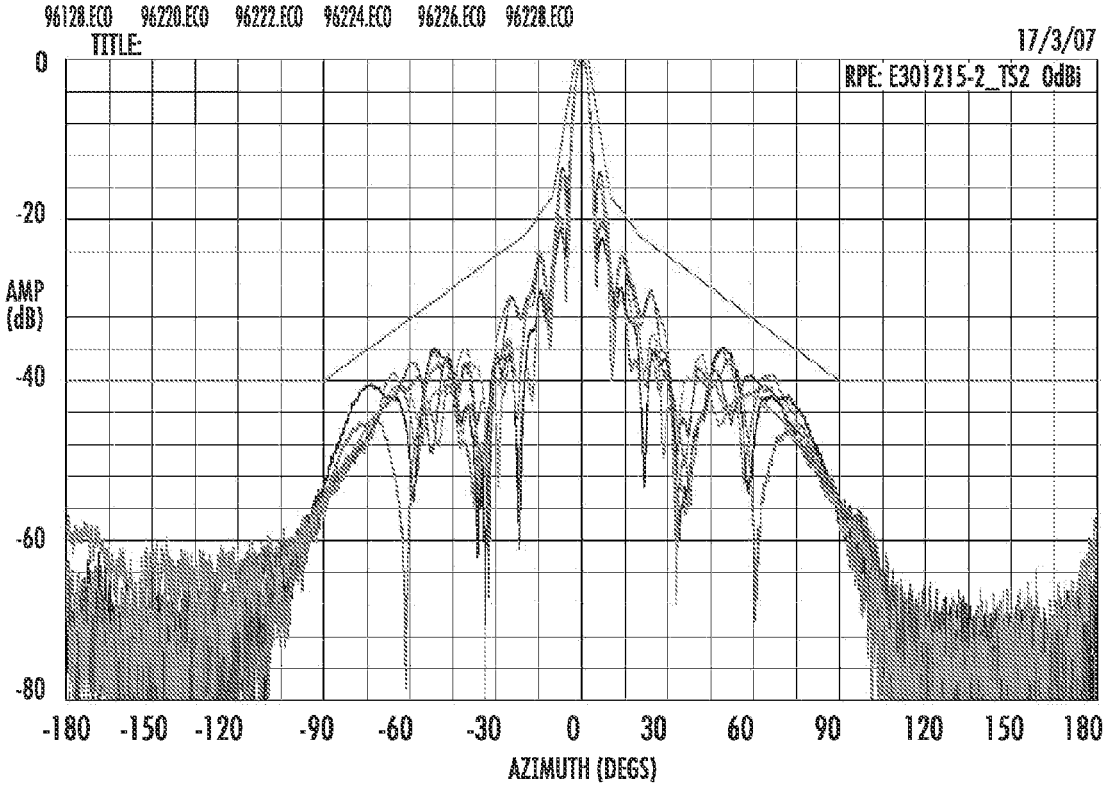
FIG. 7 is a chart showing the measured radiation patterns of a 180 mm reflector antenna, using the feed assembly of FIG. 2.

The inventor tested a 28 GHz (27.5-28.35 GHz) solid dielectric feed assembly 1 for a reflector antenna, generally as shown in FIG. 2. "Rexolite™" (Er=2.54), a microwave quality polymer formed from polystyrene cross linked with divinylbenzene, was used as the polymer solid dielectric material. A waveguide portion 8 and sub reflector 10 was formed by metalizing the outer surface area coated area(s) 6 and sub reflector surface 18 with copper. The FDTD computed return loss result of the resulting feed assembly 1 is shown in FIG. 6. The measured radiation patterns of a 180 mm reflector antenna, using the FIG. 2 feed assembly 1 configuration, is shown in FIG. 7.

Figure 8:
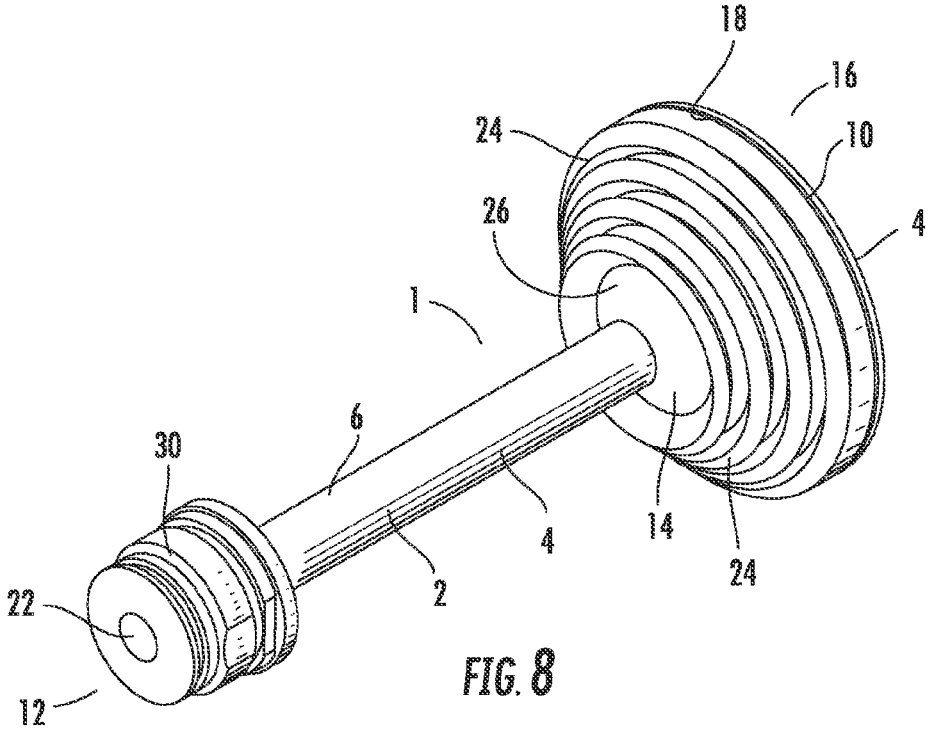
FIG. 8 is a schematic isometric view of a second embodiment of the invention.
Figure 9:
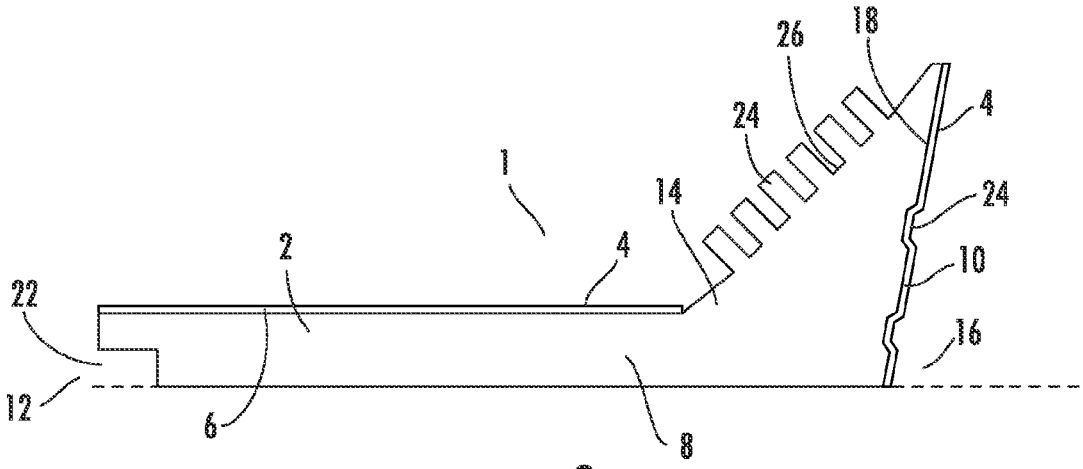
FIG. 9 is a side section, one half removed for clarity, view of a feed assembly according to a variation of the second embodiment of the invention.

In a further embodiment of the invention, demonstrated in FIGS. 8 and 9, corrugation(s) 24 may be applied to the sub reflector support 14 outer surface 26 to improve the signal pattern and return loss optimization of the resulting feed assembly. These features may be injection molded via a multi-part mold and or the corrugations machined upon a molded unitary portion 2 as an additional manufacturing step. A variety of specific sub reflector support 14 and or sub reflector surface 18 corrugation 24 configurations and their effects upon electrical performance are described in detail in U.S. Pat. No. 6,919,855, and as such are not further explained herein.

Figure 10:
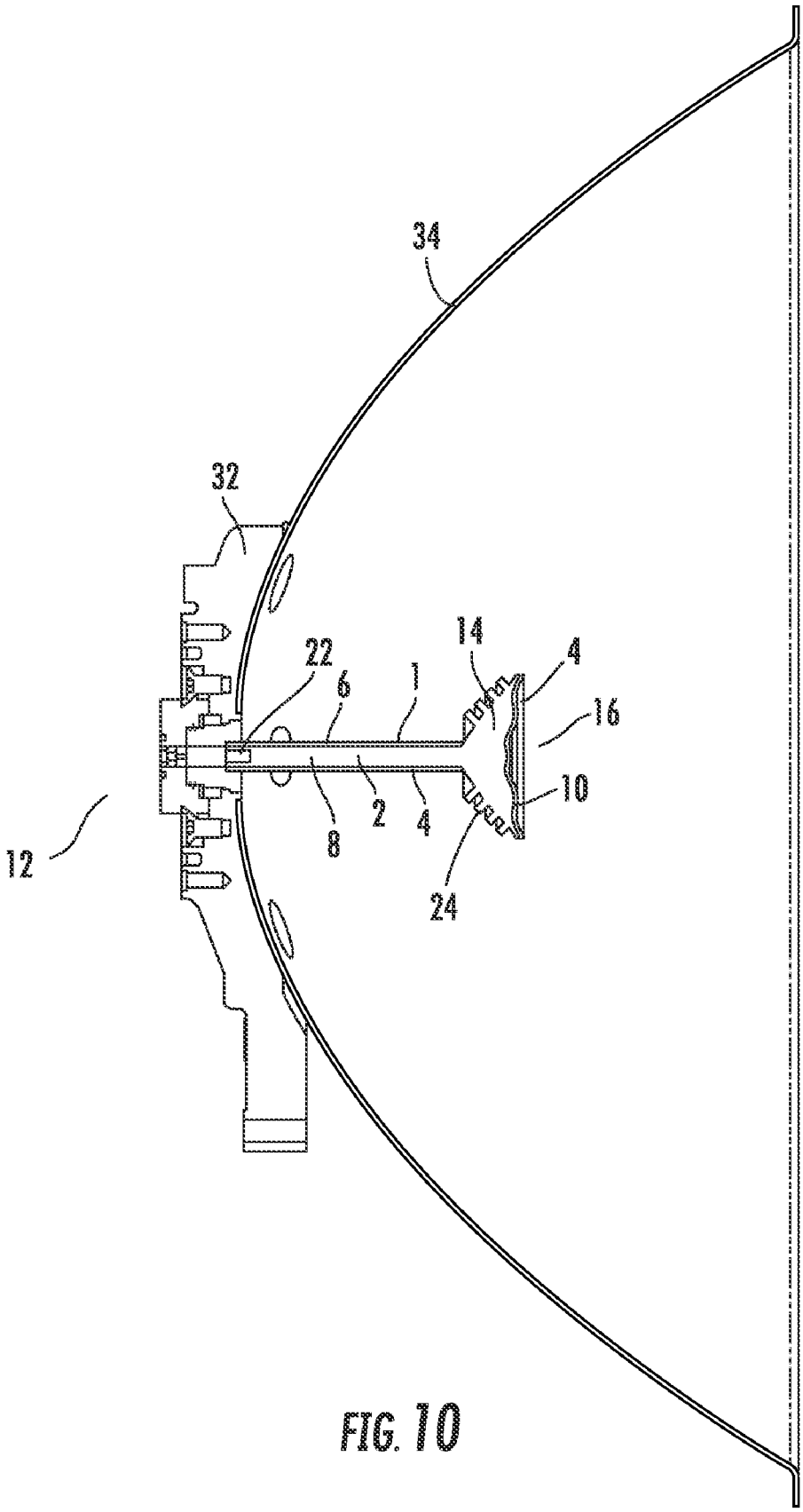
FIG. 10 is a schematic side cut-away view of a reflector antenna incorporating the feed assembly of FIG. 8.

An example of the reflector antenna resulting from the insertion of the FIG. 8 solid dielectric feed assembly 1 hub 30 into an exemplary base 32 of a reflector 34 is shown in FIG. 10. Alternatively, the hub 30 may be omitted and the feed assembly 1 coupled directly to the base 32. One skilled in the art will appreciate that the solid dielectric feed assembly 1 may be quickly assembled and or exchanged with minimal time and expense to configure the reflector antenna according to the demands of a specific installation and operating frequency, significantly reducing the range and cost of inventory and spares a supplier is required to carry.

Figure 11:
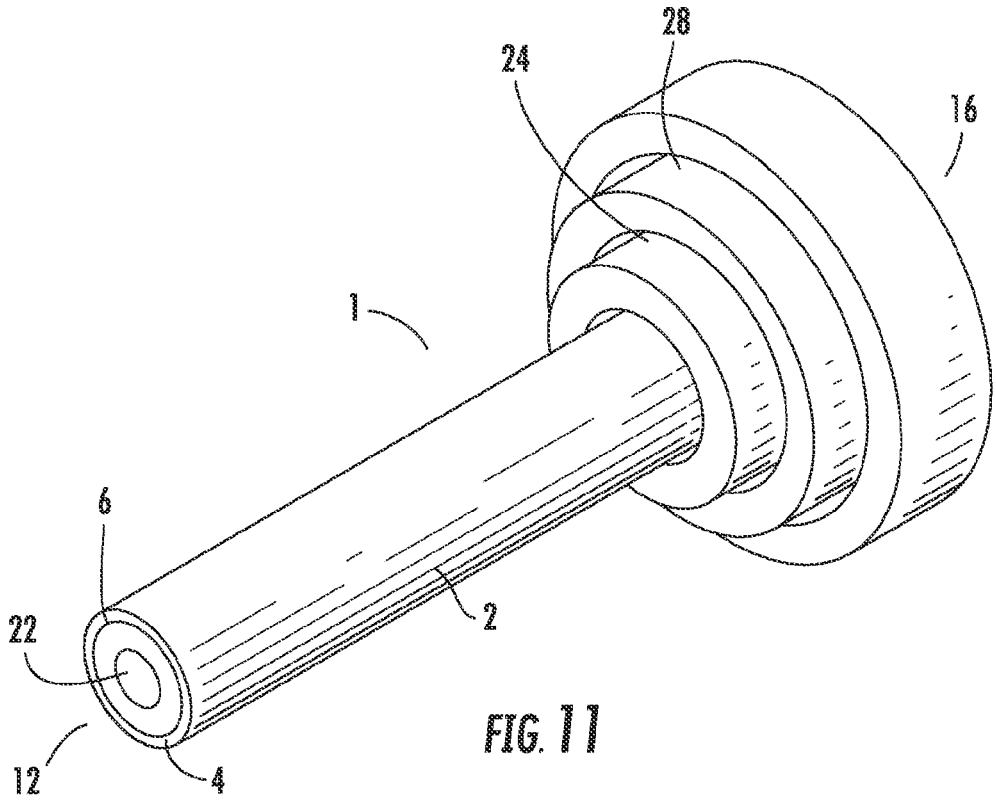
FIG. 11 is a schematic isometric view of a third embodiment of the invention.
Figure 12:
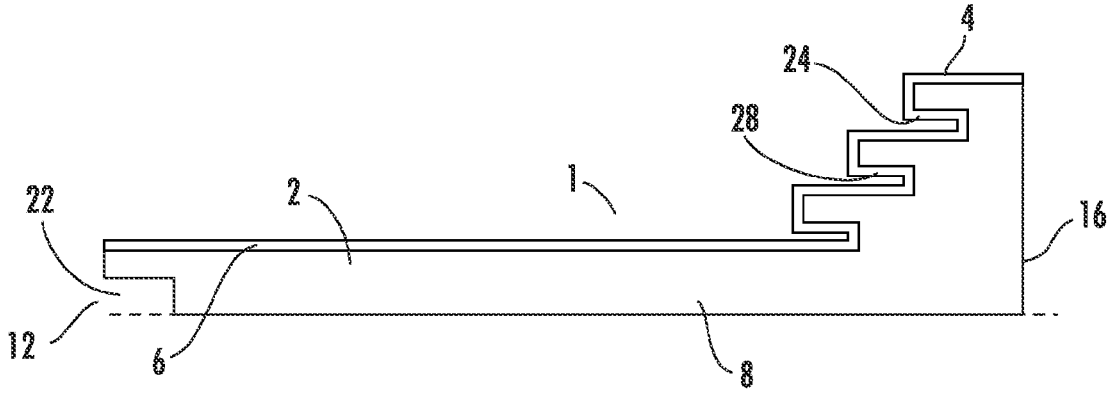
FIG. 12 is a side section, one half removed for clarity, view of a feed assembly according to a third embodiment of the invention.

As demonstrated by FIG. 11, the invention may be configured without an integral sub reflector 10 as a feed horn. A significant advantage of a feed horn type self supporting feed assembly 1 according to the invention is the elimination of the prior requirement of an environmental seal to protect the open waveguide end. Also, corrugation(s) 24 are demonstrated, applied to progressively larger diameter concentric step(s) 28 at the distal end 16 of the unitary portion 2. These corrugation (s) 24 may be easily formed via two-part mold injection molding and or machining as no overhanging edges are present along the longitudinal axis of the resulting feed assembly 1. The RF reflective material 4 is applied to an outer surface coated area that extends from the proximal end 12 to the distal end 16, including the concentric steps.

From the foregoing, it will be apparent that the present invention brings to the art a feed assembly 1 with improved electrical performance, improved structural integrity and significant manufacturing cost efficiencies. A feed assembly according to the invention is a strong, lightweight and permanently environmentally sealed component that may be repeatedly cost efficiently manufactured with a very high level of precision.

Possible applications include satellite communications and terrestrial point-to-point systems such as WiMax or Digital Mobile TV operating at frequencies between 1 and 80 GHz.

Table of Parts

| | |
|---|---|
| 1 | feed assembly |
| 2 | unitary portion |
| 4 | RF reflective material |
| 6 | outer surface coated area |
| 8 | waveguide portion |
| 10 | sub reflector |
| 12 | proximal end |
| 14 | sub reflector support |
| 16 | distal end |
| 18 | sub reflector surface |
| 22 | impedance transformer |
| 24 | corrugation |
| 26 | outer surface |
| 28 | concentric step |
| 30 | hub |
| 32 | base |
| 34 | reflector |

Where in the foregoing description reference has been made to ratios, integers, components or modules having known equivalents then such equivalents are herein incorporated as if individually set forth.

Each of the patents identified in this specification are herein incorporated by reference in their entirety to the same extent as if each individual patent was fully set forth herein for all each discloses or if specifically and individually indicated to be incorporated by reference.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A feed assembly for a reflector antenna, comprising:

a single portion of dielectric material, a proximal end of the single portion configured for connection with the reflector antenna, the single portion having a waveguide portion extending between the proximal end and a sub reflector support having a sub reflector surface at a distal end;

the waveguide portion and the sub reflector surface covered with an RF reflective material.

2. The feed assembly of claim 1, further including an impedance transformer at the proximal end.

3. The feed assembly of claim 1, wherein the RF reflective material is a metallic coating.

4. The feed assembly of claim 3, wherein the metallic coating is one of aluminum, copper, silver and gold.

5. The feed assembly of claim 1, wherein the dielectric material is non-porous.

6. The feed assembly of claim 1, further including a plurality of corrugations in an outer surface of the sub reflector support.

7. The feed assembly of claim 1, further including a plurality of corrugations in the sub reflector surface.

8. The feed assembly of claim 1, further including a transition element integrated with the proximal end.

9. A method for manufacturing a feed assembly for a reflector antenna, comprising the steps of:

forming a single portion of dielectric material, the single portion having a waveguide portion extending between a proximal end and a sub reflector support having a sub reflector surface at a distal end; and covering waveguide portion and the sub reflector surface with an RF reflective material.

10. The method of claim 9, wherein the covering is via metalizing.

11. The method of claim 9, wherein the covering is via application of metal tape.

12. The method of claim 9, further including the step of forming an impedance transformer in the proximal end.

13. The method of claim 9, further including the step of forming a plurality of corrugations in an outer surface of the sub reflector support.

14. The method of claim 13, wherein the forming of the plurality of corrugations is via machining the single portion.

15. The method of claim 9, wherein the forming is via injection molding.

16. The method of claim 9, wherein the forming is via machining a dielectric block.

17. The method of claim 9, wherein the dielectric material is polystyrene cross linked with divinylbenzene.

18. The method of claim 9, wherein the dielectric material has a dielectric constant less than 3.

* * * * *